US005652558A

United States Patent [19]

Leikus et al.

[11] Patent Number: 5,652,558

[45] Date of Patent: Jul. 29, 1997

[54] DOUBLE POLE DOUBLE THROW RF SWITCH

[75] Inventors: Vincent Leikus, Fairfield, Conn.; Yuly Bauer, Brooklyn, N.Y.

[73] Assignee: The Narda Microwave Corporation, Hauppauge, N.Y.

[21] Appl. No.: 629,807

[22] Filed: Apr. 10, 1996

[51] Int. Cl.[6] ..... H01H 53/00

[52] U.S. Cl. ..... 335/4; 333/105

[58] Field of Search ..... 335/4–6, 259; 333/104–9

[56] References Cited

U.S. PATENT DOCUMENTS 5,471,183 11/1995 Hettlage et al. ..... 335/5
5,499,006 3/1996 Engel et al. ..... 335/4

*Primary Examiner*—Lincoln Donovan
*Attorney, Agent, or Firm*—Brumbaugh, Graves, Donohue & Raymond

[57] ABSTRACT

A double pole, double throw electromechanical RF switch is configured to enable the same switch mechanical arrangement to accommodate various applications, including make-before-break or break-before-make switch operations and latching or fail-safe switching. By simple interchange of the two armatures provided, the operation of the same mechanical switch can be changed.

11 Claims, 6 Drawing Sheets

DOUBLE POLE DOUBLE THROW RF SWITCH

SPECIFICATION

Background of the Invention

This invention relates to double pole, double throw electromechanical RF switches. In particular, the invention relates to an arrangement for an electromechanical switch which is versatile as to providing either latching operation or fail-safe operation wherein in the absence of a driving current the switch returns to a predetermined switch condition. In addition, the switch configuration of the present invention is versatile in providing alternatively a break-before-make or a make-before break-switch operation.

It is therefore an object of the present invention to provide a versatile double pole double throw electromechanical RF switch which is simple and inexpensive to manufacture and provides versatility as to its latching and switching characteristics so that a variety of switch configurations can be realized using common components.

SUMMARY OF THE INVENTION

In accordance with the invention there is provided a double pole, double throw electromechanical RF switch, which includes an RF switch cavity having four RF ports, each with a coaxial inner conductor extending into the cavity and having a switch contact thereon. Four contact leaf members are provided in the RF cavity, each being moveable between a first contact position connecting two of the inner conductor switch contacts and a second position spaced from the contacts. The switch includes an electromagnet having a central passage with two armatures in the passage one at each end of the passage. A spring urges the two armatures away from each other and out of the passage. A leaf spring is provided interconnecting each of the armatures to two of the contact leaf members. The connection between the contact members and the armature by the leaf springs is arranged such that when current is provided to the electromagnet and the armatures are drawn into the central passage by magnetic forces, the first armature moves the two contact leaf members connected thereto from the first contact position to the second contact position and the second armature moves the other two contact leaf members from the second position to the first position.

In a preferred embodiment the switch contacts are arranged at the corners of a square. The leaf springs are each connected to contact leaf members on opposite sides of the square and to armatures at opposite ends of the electromagnet.

Where latching operation is desired, one of the armatures is provided with a permanent magnet for holding the armatures together after they have been drawn into the central passage by magnetic force of the electromagnet to provide a latching switch operation.

In a further variation of the invention the first armature is made longer than the second armature to provide a break-before-make switch operation. Alternatively, the second armature can be made longer than the first armature to provide a make-before-break operation.

For a better understanding of the present invention, together with other and further objects, reference is made to the following description, taken in conjunction with the accompanying drawings, and its scope will be pointed out in the appended claim.

DESCRIPTION OF THE PREFERRED EMBODIMENTS

Figure 1:
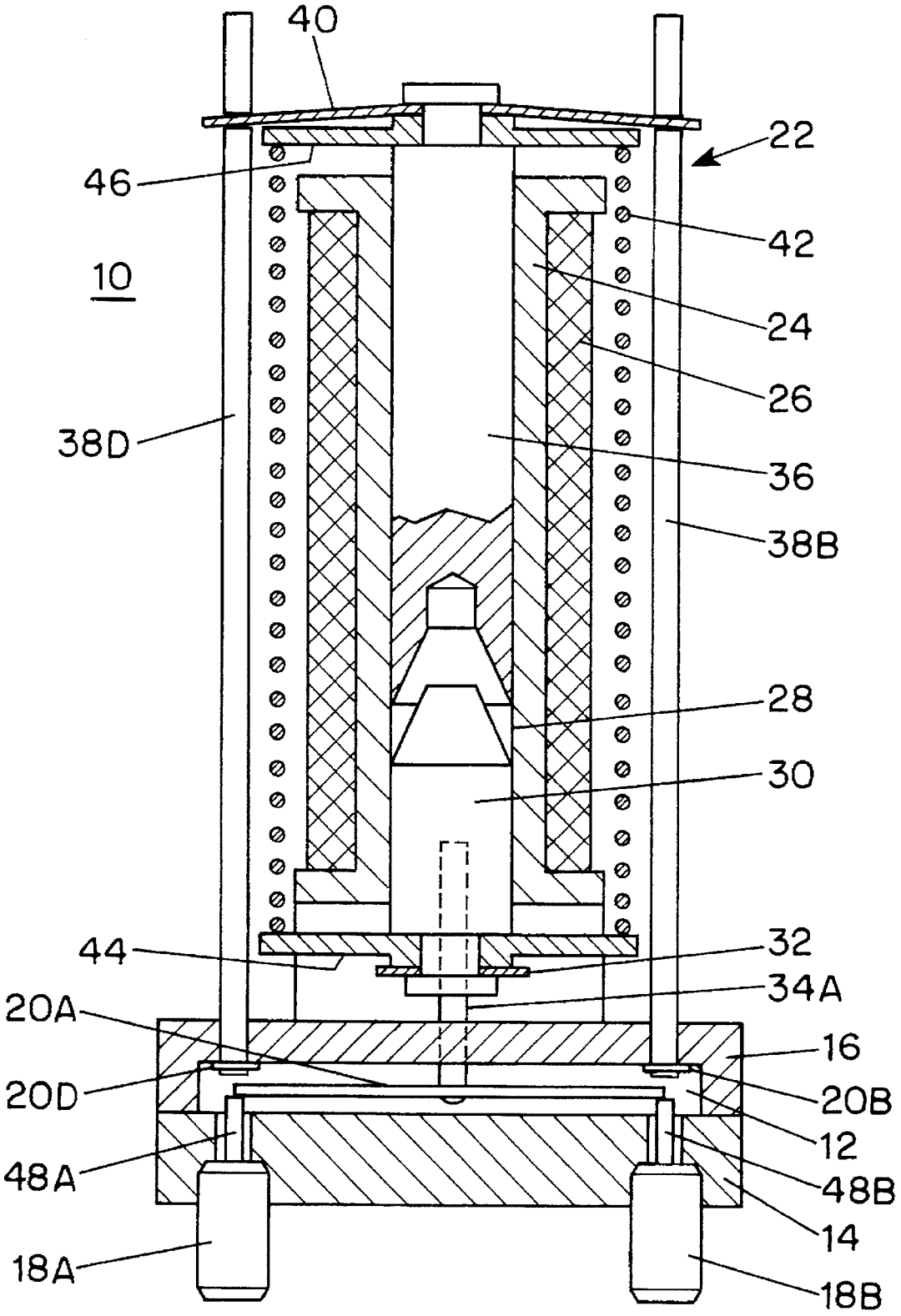
FIG. 1 is a cross-sectional view of a first embodiment of the invention in the unswitched condition.

FIG. 1 is an cross-sectional view of double pole, double throw RF switch 10 in accordance with a first preferred embodiment of the present invention. Switch 10 includes an RF switch cavity 12, which is enclosed between conductive plates forming bottom wall 14 and top wall 16. Coaxial connectors, such as SMA type connectors, comprising RF ports 18A, 18B, 18C and 18D are arranged on bottom wall 14 in a square arrangement, such that their coaxial inner conductors 48 are at corners of a square. The upper end of each inner conductor 48 provides a contact surface. Within the cavity 12 there are provided four contact leaf members 20A, 20B, 20C and 20D, arranged as sides of the square with RF ports 48 at the corners.

Mounted on top wall 16 of RF cavity 12 there is provided an electromagnetic solenoid assembly 22 which is preferably enclosed in a cover, which is not illustrated in the drawings. Solenoid assembly 22 includes a spool 24 around which a coil 26 is wound to provide a linear electromagnet having a central passage 28. Spool 24 is preferably aluminum coated with Teflon to provide lubrication and high voltage insulation. Spool 24 is mechanically supported on upper wall 16 of cavity 12. A first armature 30 is received at the lower end of passage 28 adjacent RF cavity 12. Armature 30 is formed of ferromagnetic material which is drawn into passage 28 when current is supplied to coil 26. A leaf spring 32 connects the lower end of armature 30 with two push rods 34A and 34C (not shown) connected respectively to the centers of contact leaf members 20A and 20C.

A second armature 36 is received in the upper portion of passage 28 remote from RF cavity 12. Upper armature 36 is connected to push rods 38B and 38D by upper leaf spring 40. Push rods 38B and 38D are connected respectively to the centers of contact leaf members 20B and 20D. Compression spring 42 is arranged between flanges 44 and 46 formed respectively on the outer ends of armatures 30 and 36, and urges the flanges and armatures out of passage 28 and away from each other.

When no current is provided to coil 26, in the unswitched condition shown in FIG. 1, spring 42 urges armature 30 downwardly toward RF cavity 12 and leaf spring 32 pushes push rods 38A and 38C downwardly to respectively cause contact leaf member 20A and 20C to be in contact with the coaxial inner conductors 48 of RF ports 18. Spring 42 also urges armature 36 upwardly causing leaf spring 40 to pull push rods 38B and 38D upwardly pulling contact leaf members 20B and 20D away from inner conductors 48 of RF ports 18, as shown in FIG. 1. In the unswitched condition, contact leaf member 20A electrically connects the contact surfaces at the ends of inner conductors 48A and 48B while contact leaf member 20C connects the contact surfaces of coaxial inner conductors 48C and 48D. Thus port 18A is connected to port 18B and part 18C is connected to part 18D the other ports being isolated.

Figure 2:
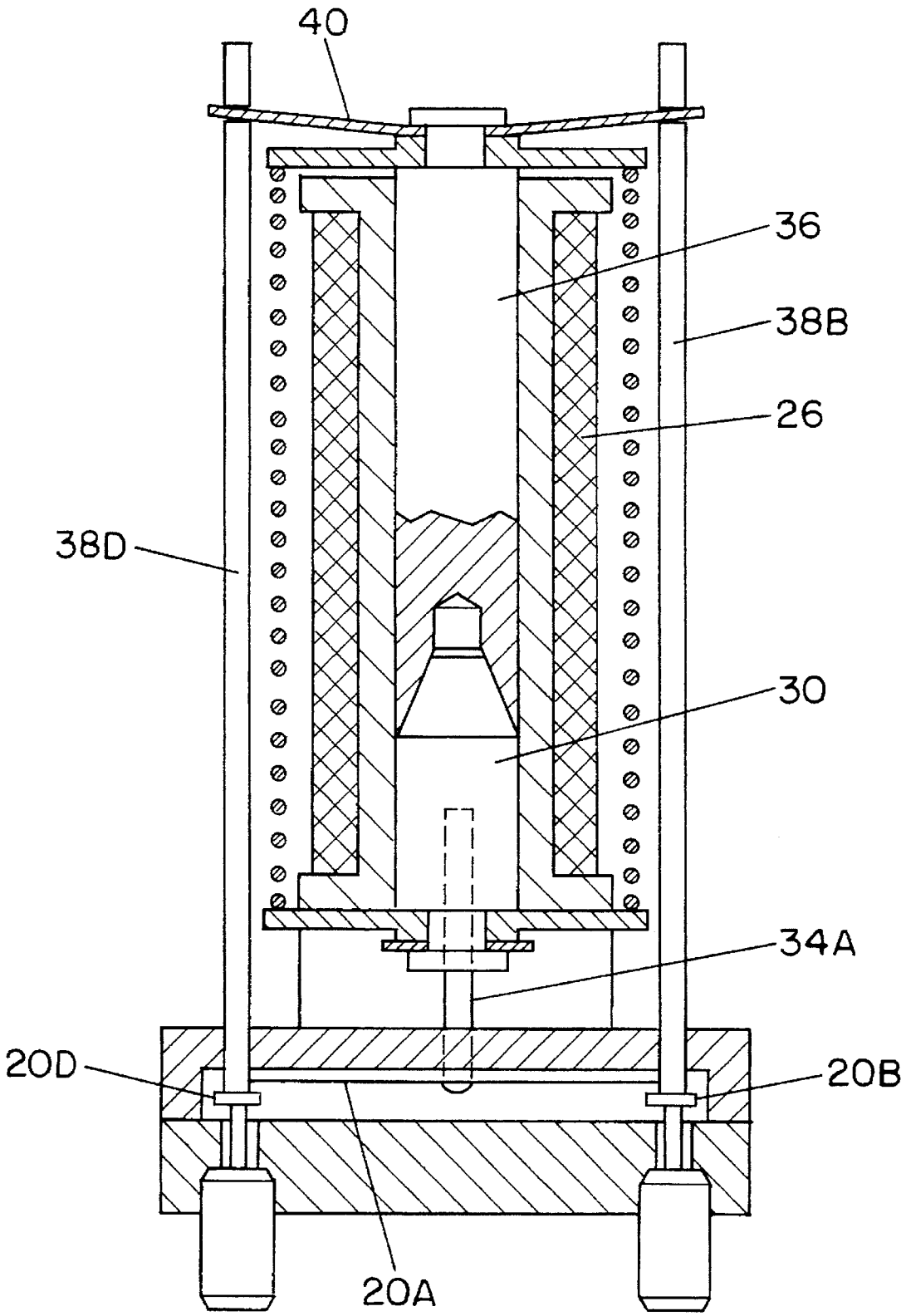
FIG. 2 is a cross-sectional view of the FIG. 1 embodiment in the switched condition.
Figure 3:
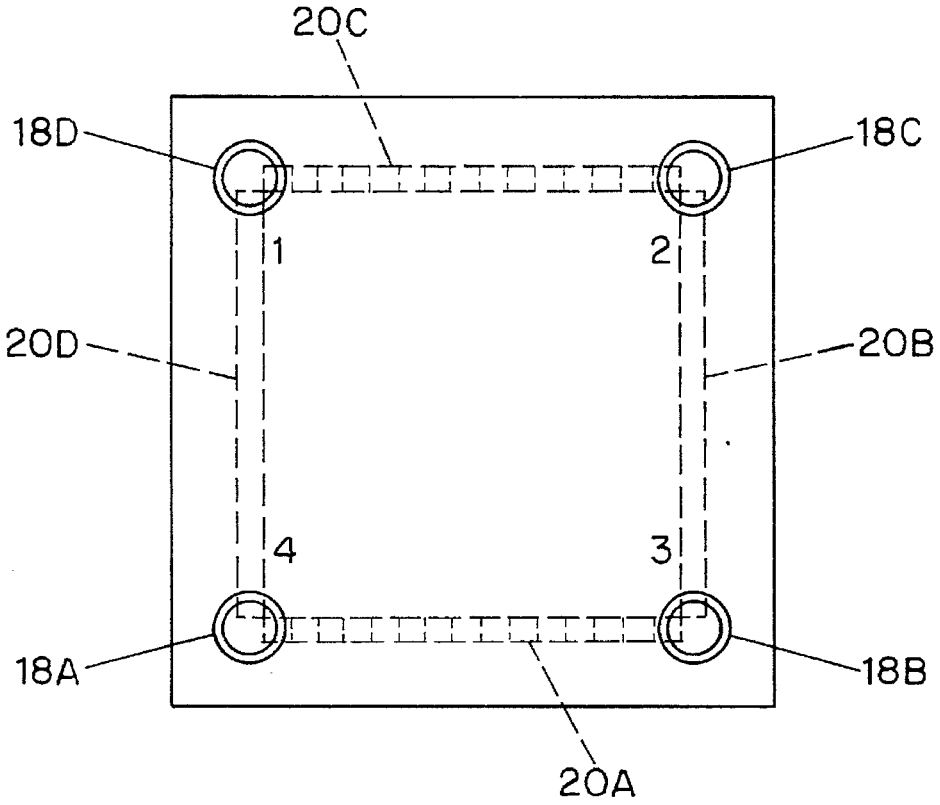
FIG. 3 is a bottom view of the FIG. 1 embodiment showing the arrangement of switch connections in the unswitched position.
Figure 4:
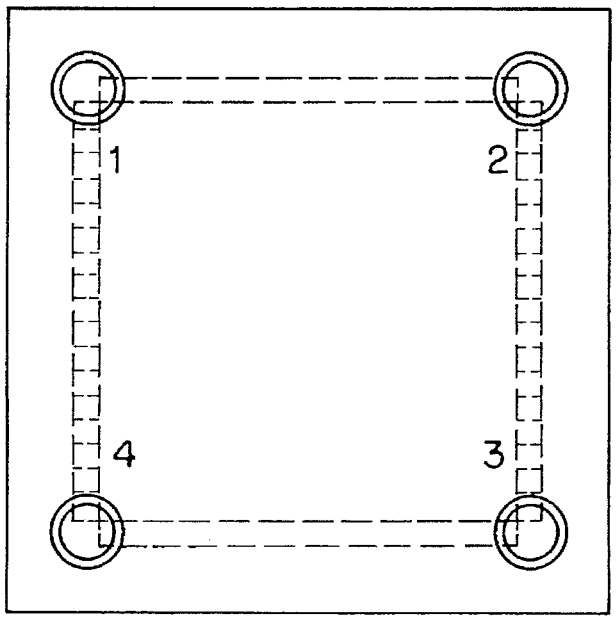
FIG. 4 is a bottom view of the FIG. 1 embodiment showing the arrangement of the switch connections in the switched condition.

FIGS. 2 and 4 illustrate the configuration of the FIG. 1 switch in the switched condition. Activation of a current through coil 26 generates a magnetic field which pulls armatures 30 and 36 into passage 28 and into contact with each other as shown in FIG. 2. In this position armature 30 pulls contact leaf members 20A and 20C upward adjacent wall 16 of RF chamber 12 and out of contact with inner coaxial conductors 48. The downward motion of armature 36 into passage 28 causes leaf spring 40 to push rods 38B and 38D downward causing contact leaf members 20B and 20D to move downward such that contact leaf member 20B interconnects inner conductors 48B and 48C and contact leaf member 20D interconnects coaxial inner conductors 48A and 48D. Accordingly, in the second position shown in FIG. 2, port 18A is connected to 18D and part 18B is connected to port 18C, with the other ports being isolated. Double pole, double throw switch 10 of FIGS. 1 through 4 remains in the switched condition of FIG. 2 while current is applied. When current is no longer applied to coil 26, spring 42 returns armatures 30 and 36 to there original outer position, as shown in FIG. 1. Accordingly, FIG. 1 is a "fail safe" condition for switch 10.

Switch 10 of FIGS. 1 through 4 can be arranged to provide either make-before-break or a break-before-make switching operation. As illustrated in FIGS. 1 and 2, the switch will operate as make-before-break. Armature 36 is larger in length than armature 30 and it is subject to a greater magnetic attraction force by the magnetic field generated by coil 26 when current is applied. Accordingly, armature 36 will move down a short period before armature 30 moves up. Thus contact leaf members 20B and 20D are brought downward into the connecting position prior to the upward motion of contact leaf members 20A and 20D when current is applied to coil 26. This results in a make-before-break operation when switching form the unswitched condition of FIG. 1 to the switched position of FIG. 2. When current is discontinued, the declining magnetic field will release armature 30 under the influence of spring 42 prior to the release of armature 36. Accordingly, contact leaf members 20A and 20C will connect prior to the discontinuation of contact leaf members 20B and 20D, again forming a make-before-break operation.

In the event it is desired to use a switch shown in the embodiment of FIGS. 1 through 4 in a break-before-break application, armature 36 will be made shorter than armature 30. The greater length of armature 30 will cause armature 30 to respond to the magnetic field first, causing contact leaf members 20A and 20C to be brought out of the first contact position of FIGS. 1 and 3 to the second non-contact positions of FIGS. 2 and 4 prior to armature 36 pushing contact leaf members 20B and 20C into the contacting position shown in FIG. 2. Accordingly, by making the central portion of armature 30 greater in length than the central portion of armature 36, the switch of FIGS. 1 through 4 can easily be configured to have a break-before-make operation. The interchange of armatures can be easily accomplished by using the same parts, interchanged in position.

A second preferred embodiment consisting of a latching, double pole, double throw RF switch is illustrated in FIGS. 5 through 8. Switch 50 shown in FIGS. 5 through 8 is similar to switch 10 shown in FIGS. 1 through 4, with the exception that first armature 52 is provided with a permanent magnet 54 provided at the end facing second armature 56. Second armature 56 has a nonmagnetic spacer 58 made from nonferrous metal or dielectrical to provide an appropriate spacing betewen permanent magnet 54 and armature 56 in the switched condition, as will be described.

The RF cavity 12, RF ports 18, coaxial inner conductors 48 and contact leaf members 20 of switch 50 are identical to the corresponding members of switch 10. Likewise the push rods 34 and 38 and leaf springs 32 and 40 are provided to interconnect armatures 52 and 56 with the corresponding contact leaf members.

Figure 5:
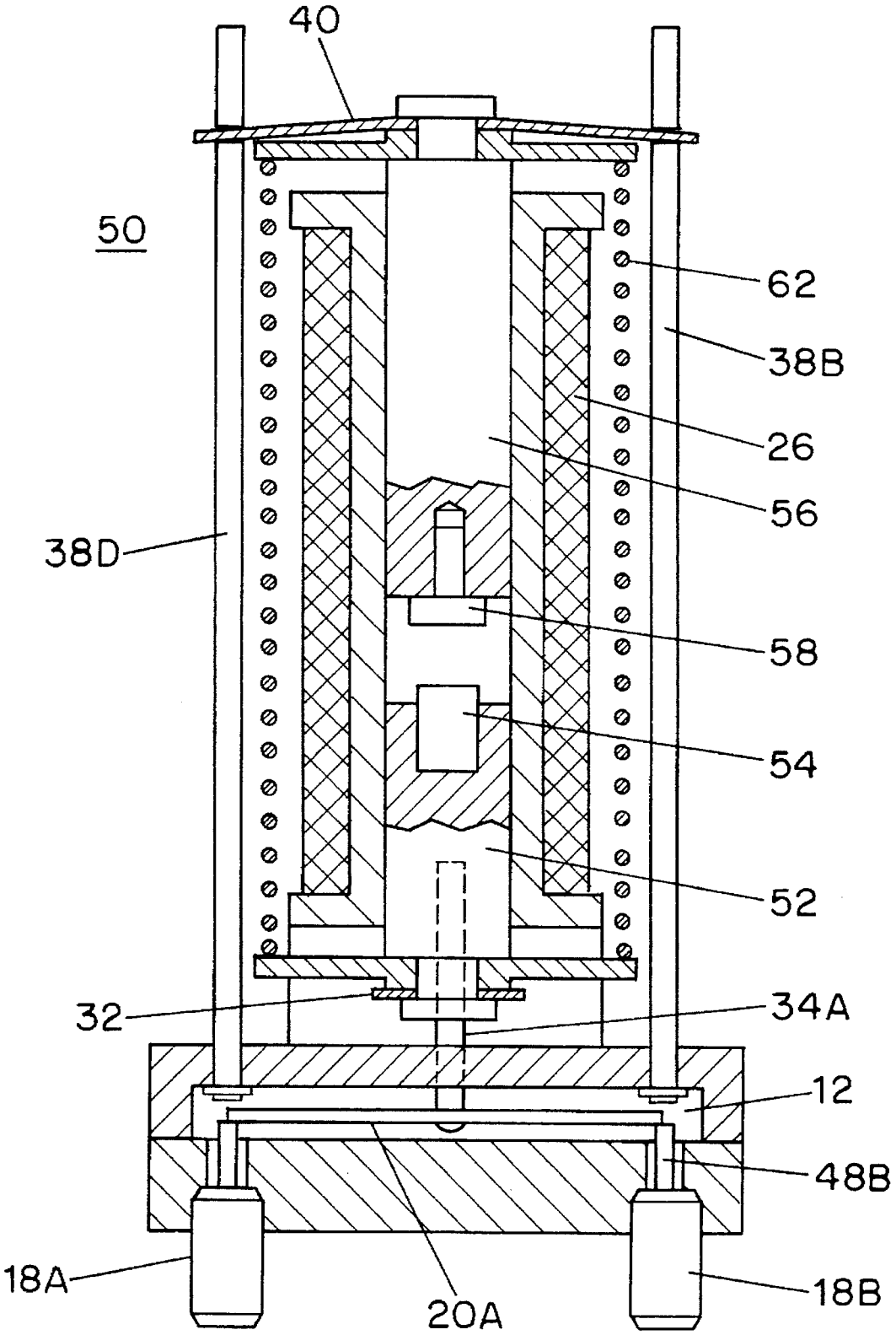
FIG. 5 is a cross-sectional view of a second preferred embodiment of the invention for providing latching switch operation in the unswitched condition.
Figure 6:
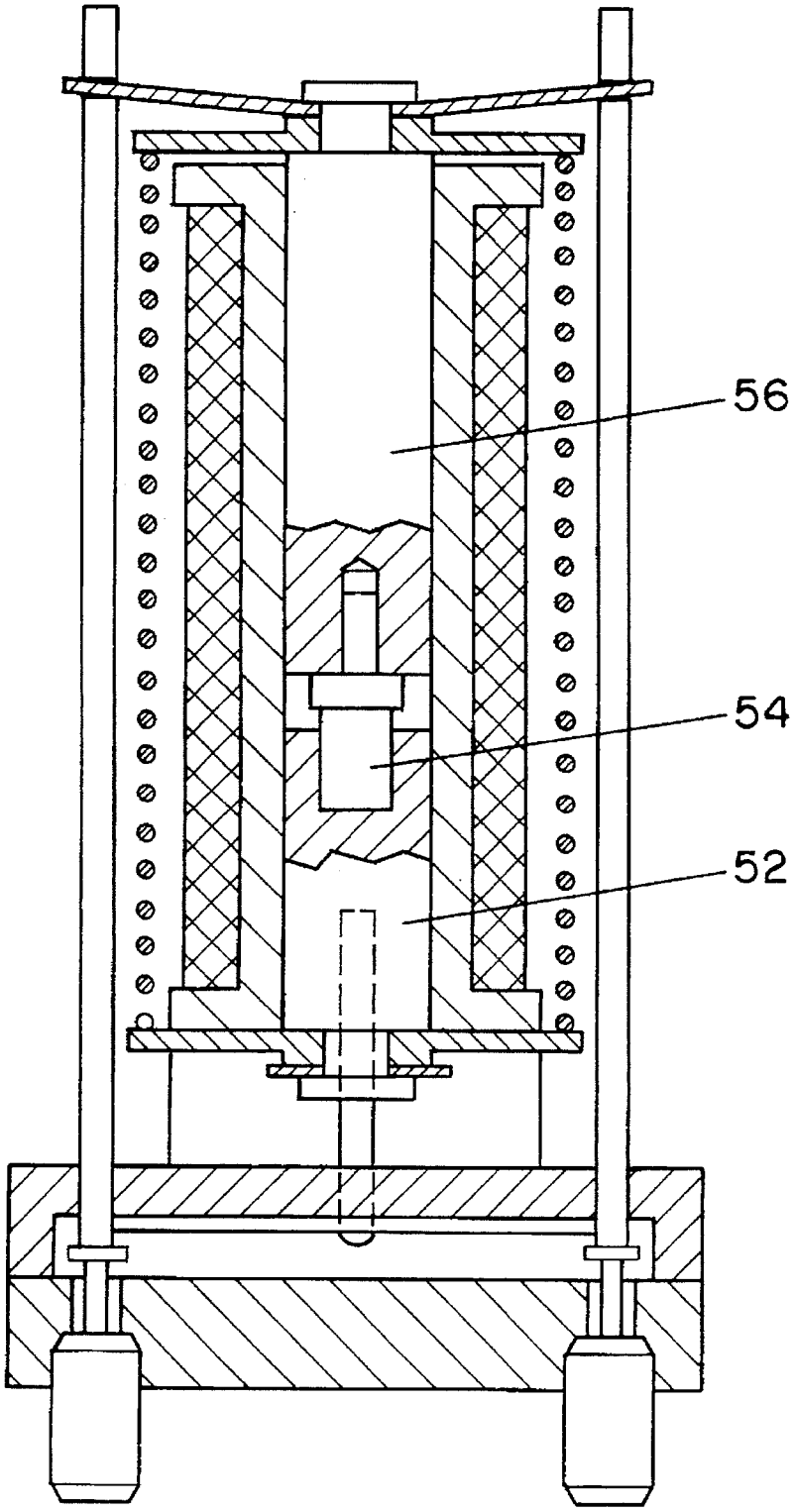
FIG. 6 is a cross-sectional view of the FIG. 5 embodiment in the switched condition.
Figure 7:
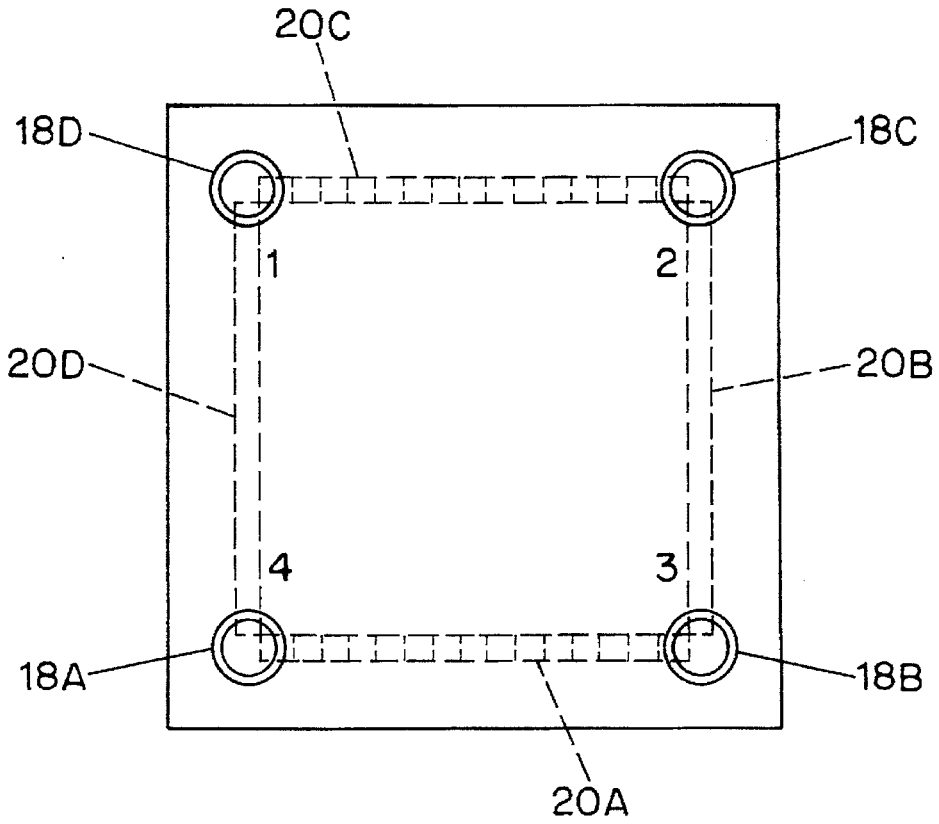
FIG. 7 is a bottom view of the FIG. 5 embodiment in the unswitched condition.
Figure 8:
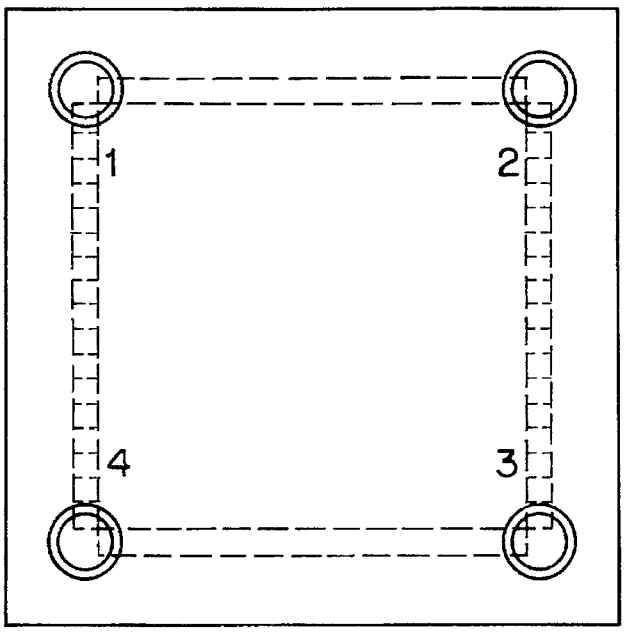
FIG. 8 is a bottom view of the FIG. 5 embodiment in the switched condition.

Switch 50 operates in a latching mode as follows. In the unswitched condition as shown in FIGS. 5 and 7, spring 62 maintains armatures 52 and 56 separated from each other at a distance whereat permanent magnet 54 has insufficient attraction to ferromagnetic armature 56 to act against the force of spring 62. In the unswitched condition, ports 18A and 18B are connected and ports 18C and 18D are connected. By application of a current pulse to coil 26 in a direction that causes the lower end of armature 56 to have a magnetic polarity opposite to the magnetic polarity of the upper end of permanent magnet 54, armatures 52 and 56 are attracted to each other, armature 56 being the first to move because of its greater magnetic core length. The magnetic attraction between the lower end of armature 56 and the permanent magnet 54, enhanced by the electromechanically induced magnetic field of coil 26, pulls armatures 52 and 56 together as shown in FIG. 6. In this condition RF switching takes place in a make-before-break switching operation and armature 52 and 56 remain together after the current pulse is discontinued because of the magnetic attraction between permanent magnet 54 and armature 56 in the configuration of FIG. 6, wherein their spacing is determined by the thickness of spacer 58. Switch 50 will remain in the switched condition of FIG. 6 until an opposite direction current pulse is applied to coil 26, causing the induced magnetic field in core 56 to repel the permanent magnetic field of permanent magnet 54 and thereby allowing armature 52 and 56 to separate into the unswitched condition of FIG. 1. The presence of permanent magnet 54 and the shorter length of armature 52 again results in a make-before-break switching operation from the switched to the unswitched condition.

Those skilled in the art will recognize that switch 50 of FIGS. 5 through 7 can likewise be changed to a break-before-make operation by interchanging armature 52, including permanent magnet 54, with armature 56.

Those skilled in the art will recognize that switches described herein, having to RF ports comprising coaxial connectors, may also be implemented in other transmission lines, such as stripline or microstrip in configurations. It is accordingly understood that the term coaxial inner conductors applies to the corresponding conductors of such other transmission lines.

While there has been described what is believed to be the preferred embodiments of the invention, those skilled in the art will recognize that other and further modifications may be made thereto without departing from the spirit of the invention and it is intended to claim all such changes and modifications as fall within the true scope of the invention.

We claim:

1. A double pole, double throw electromechanical RF switch comprising:

an RF switch cavity having four RF ports, each having a coaxial inner conductor extending into said cavity and having a switch contact thereon;

four contact leaf members in said RF cavity, each of said contact leaf members being moveable between a first contact position connecting two of said inner conductor switch contacts and a second position spaced from said inner conductor switch contacts;

an electromagnet having a central passage, a first armature extending into said central passage from a first end thereof;

a second armature extending into said central passage from a second end thereof;

a spring urging said armatures out of said central passage;

a first leaf spring interconnecting said first armature and a second said contact leaf members; and a second leaf spring interconnecting said second armature and the other two of said contact leaf members;

said armatures being connected to said contact members by said leaf springs in a manner whereby when current is provided to said electromagnet and said armatures are drawn into said central passage by magnetic force, said first armature moves said two contact leaf members connected thereto from said first contact position to said second position, and said second armature moves said other two contact leaf members from said second position to said first contact position.

2. An RF switch as specified in claim 1 wherein said inner conductor switch contacts are arranged in a square in said RF cavity.

3. An RF switch as specified in claim 2, wherein each of said contact leaf members are arranged on a side of said square.

4. An RF switch as specified in claim 3 wherein said first and second leaf springs are each connected to contact leaf members on opposite sides of said square.

5. An RF switch as specified in claim 1 wherein said second armature is arranged to be drawn into said passage before said first armature, whereby said switch is a make before break switch.

6. An RF switch as specified in claim 1 wherein said first armature is arranged to be drawn into said passage before said second armature, whereby said switch is a break before make switch.

7. A double pole, double throw electromechanical RF switch comprising:

an RF switch cavity having four RF ports, each having a coaxial inner conductor extending into said cavity and having a switch contact thereon;

four contact leaf members in said RF cavity, each of said contact members being moveable between a first contact position connecting two of said inner conductor switch contacts and a second position spaced from said inner conductor switch contacts;

an electromagnet having a central passage, a first armature extending into said central passage from a first end thereof;

a second armature extending into said central passage from a second end thereof;

a spring urging said armatures out of said passage;

a first interconnection arrangement including a first leaf spring and two push rods interconnecting said first armature and two of said contact leaf members; and a second interconnection arrangement including a second leaf spring and two push rods interconnecting said second armature and the other two of said contact leaf members;

said armatures being connected to said contact members by said leaf springs and push rods in a manner whereby when current is provided to said electromagnet and said armatures are drawn into said central passage by magnetic force, said first armature moves said two contact leaf members connected thereto from said first contact position to said second position, and said second armature moves said other two contact leaf members from said second position to said first contact position.

8. A latching, double pole, double throw electromechanical RF switch comprising:

an RF switch cavity having four RF ports, each having a coaxial inner conductor extending into said cavity and having a switch contact thereon;

four contact leaf members in said RF cavity, each of said contact leaf members being moveable between a first contact position connecting two of said inner conductor switch contacts and a second position spaced from said inner conductor switch contacts;

an electromagnet having a central passage, a first armature extending into said central passage from a first end thereof;

a second armature extending into said central passage from a second end thereof;

a permanent magnet mounted on one of said armatures, the other armature being fabricated of ferromagnetic material;

a spring urging said armatures out of said passage;

a first leaf spring interconnecting said first armature and two of said contact leaf members;

a second leaf spring interconnecting said second armature and the other two of said contact leaf members;

said armatures being connected to said contact leaf members by said leaf springs in a manner whereby when a first current pulse is provided to said electromagnet and said armatures are drawn into said central passage by magnetic force, said first armature moves said two contact leaf members connected thereto from said first contact position to said second position, and said second armature moves said other two contact leaf members from said second position to said first contact position, and said armatures, said spring and said permanent magnet being arranged so that said permanent magnet holds said armatures in said passage against the force of said spring after said first current pulse, and when a second current pulse, opposite to said first current pulse, is provided to said electromagnet, said armatures are pushed out of said central passage by magnetic and spring forces, said first armature moves said two contact leaf members connected thereto to said first contact position and said second armature moves said other two contact members to said second position and said spring holds said armatures out of said passage.

9. An RF switch as specified in claim 8 wherein said second armature is arranged to be drawn into said passage before said first armature, whereby said switch is a make before break switch.

10. An RF switch as specified in claim 8 wherein said first armature is arranged to be drawn into said passage before said second armature, whereby said switch is a break-before-make switch.

11. An RF switch as specified in claim 8 wherein there is provided a non-magnetic spacer between said ferromagnetic material and said permanent magnet.

* * * * *

UNITED STATES PATENT AND TRADEMARK OFFICE

CERTIFICATE OF CORRECTION

PATENT NO. : 5,652,558

DATED : July 29, 1997

INVENTOR(S) : Vincent Leikus, et al.

It is certified that error appears in the above-identified patent and that said Letters Patent is hereby corrected as shown below:

Col. 1, line 67, "claim" should read --claims.
Col. 3, line 11, "part" should read --port--; line 12, "part" should read --port--; line 27, "part" should read --port--;
Col. 3, line 32, "there" should read --their--; line 47, "form" should read --from--; line 56, "break-before-break" should read --break-before make--.
Col. 4, line 56, "to" should read --two--.
Col. 5, line 18, "a second said contact leaf members; and" should read --two of said contact leaf members; and--.

Signed and Sealed this

Second Day of June, 1998

*Attest:*

Bruce Lehman

BRUCE LEHMAN

*Attesting Officer*

*Commissioner of Patents and Trademarks*